US012385656B2

(12) United States Patent
Harpenau et al.

(10) Patent No.: US 12,385,656 B2
(45) Date of Patent: Aug. 12, 2025

(54) EXHAUST VENT DOORS

(71) Applicant: InOvate Acquisition Company, Jupiter, FL (US)

(72) Inventors: Richard Harpenau, Jupiter, FL (US); Clifford Budnick, Jupiter, FL (US); James Ortiz, Jupiter, FL (US); Timothy Podnar, Crescent Township, PA (US)

(73) Assignee: InOvate Acquisition Company, Jupiter, FL (US)

( * ) Notice: Subject to any disclaimer, the term of this patent is extended or adjusted under 35 U.S.C. 154(b) by 442 days.

(21) Appl. No.: 16/412,074

(22) Filed: May 14, 2019

(65) Prior Publication Data

US 2020/0363096 A1 Nov. 19, 2020

(51) Int. Cl.
*F24F 7/00* (2021.01)
*F24F 13/14* (2006.01)

(52) U.S. Cl.
CPC ..... *F24F 7/00* (2013.01); *F24F 13/1426* (2013.01); *F24F 2007/001* (2013.01); *F24F 2007/0025* (2021.01); *F24F 2013/148* (2013.01)

(58) Field of Classification Search
CPC ..... F24F 13/1426; F24F 13/14; F24F 13/084; F24F 13/06; F24F 13/082; F24F 2007/001; F24F 2007/0025; F24F 2013/148; F24F 7/04; F24F 2221/52; F23J 11/06; F23L 17/00; F23L 17/12
USPC ..... 454/360
See application file for complete search history.

(56) References Cited

U.S. PATENT DOCUMENTS

| | | | | |
|---|---|---|---|---|
| 5,272,605 | A * | 12/1993 | Johnstone | G09F 13/04 439/537 |
| 5,383,816 | A | 1/1995 | Marcello et al. | |
| 5,916,023 | A | 6/1999 | Meyer | |
| 6,113,488 | A * | 9/2000 | Tiede | F24F 13/082 454/276 |
| 9,157,652 | B2 * | 10/2015 | Chamness | F24F 11/75 |
| 9,383,117 | B2 | 7/2016 | Labrecque | |
| 9,850,620 | B2 | 12/2017 | Ott | |
| 10,876,757 | B2 * | 12/2020 | Volpe | F24F 13/0245 |
| 2002/0098793 | A1 * | 7/2002 | Achen | F24F 13/084 454/271 |
| 2009/0023379 | A1 * | 1/2009 | Bredahl | F24F 13/1413 454/363 |
| 2009/0280737 | A1 | 11/2009 | Jacak et al. | |
| 2010/0132560 | A1 * | 6/2010 | Sundhar | B03C 3/09 96/64 |

(Continued)

FOREIGN PATENT DOCUMENTS

EP 2784405 A1 10/2014

*Primary Examiner* — Steven B McAllister
*Assistant Examiner* — Charles R Brawner
(74) *Attorney, Agent, or Firm* — Troutman Pepper Locke LLP; Gabrielle L. Gelozin

(57) ABSTRACT

A wall exhaust vent (e.g., for a dryer or other HVAC system) can include a housing defining a vent opening, and one or more bumpers on or at least partially within the housing and configured contact a door of the wall exhaust vent in a closed position. The one or more bumpers can include a bumper body, and a magnet disposed at least partially within the bumper body that is configured to magnetically interact with the door of the wall exhaust vent to bias the door to the closed position.

7 Claims, 20 Drawing Sheets

(56) References Cited

U.S. PATENT DOCUMENTS

| | | | | |
|---|---|---|---|---|
| 2010/0159821 | A1* | 6/2010 | Bredahl | F24F 13/082<br>454/358 |
| 2011/0025174 | A1* | 2/2011 | Ye | H05K 7/20172<br>312/213 |
| 2011/0097990 | A1 | 4/2011 | Charron | |
| 2011/0312262 | A1* | 12/2011 | Grandmaison | F24F 13/084<br>454/276 |
| 2012/0264363 | A1* | 10/2012 | Ramsay | F24F 7/00<br>454/359 |
| 2014/0287675 | A1 | 9/2014 | Abrecque | |
| 2019/0338982 | A1* | 11/2019 | Volpe | F24F 13/12 |

* cited by examiner

EXHAUST VENT DOORS

BACKGROUND

1. Field

The present disclosure relates to exhaust system exterior terminations, such as heating, ventilation, and air conditioning (HVAC) systems, e.g., the exit point for moving air from the dryer exhaust, kitchen, and bathroom.

2. Description of Related Art

The International Residential Code and International Mechanical Code require clothes exhausts to terminate on the outside of the building. Most common exterior terminations vent through the roof, side wall, and occasionally through the soffit. To meet other aspects of exhaust building code, terminations must have a backdraft damper and screens are disallowed.

Exhaust vents that meet building code are made of either plastic or metal. Plastic vents deteriorate at a rapid rate due to UV exposure and other weathering natural elements. Metal vents may be restrictive in their design with respect to airflow efficiency or their ability to process lint and other particulates effectively.

Also, finding a universally applicable exhaust side wall vent is challenging as siding materials vary. In both new construction and after-market scenarios, concealed duct work installation is inconsistent in how it routes to the facade of single-family and multi-family residential dwellings.

Such conventional methods and systems have been considered satisfactory for their intended purpose. However, there is still a need in the art for improved wall exhaust vents. The present disclosure provides a solution for this need.

SUMMARY

In accordance with at least one aspect of this disclosure, a wall exhaust vent (e.g., for a dryer or other HVAC system) can include a housing defining a vent opening, and one or more bumpers on or at least partially within the housing and configured contact with a door of the wall exhaust vent in a closed position. The one or more bumpers can include a bumper body, and a magnet disposed at least partially within the bumper body that is configured to magnetically interact with the door of the wall exhaust vent to bias the door to the closed position.

The vent can include the door. The door can be rotatably attached to the housing (e.g., via one or more hinges) and configured to at least partially cover the vent opening in the closed position.

In certain embodiments the bumper body can be made of an elastic material. For example, the bumper body can be made of silicone or rubber.

In certain embodiments, the magnet is a permanent magnet. The door can include a ferromagnetic material (e.g., iron, nickel, or cobalt), or any other suitable material. The magnet can be a rare earth magnet, for example (e.g., neodymium). Any suitable type of magnet is contemplated herein. In certain embodiments, the bumper body can include a flanged head portion and a hollow neck portion configured to at least partially retain the magnet.

The one or more bumpers can include two bumpers. Each bumper can be positioned to be proximate to a lower corner of the door in the closed position.

The one or more bumpers can be disposed partially within a door interface structure. The door interface structure can be at least partially within a recess of the housing. In certain embodiments, the door interface structure can be slanted relative to a plane of the housing such that the door can be additionally biased to contact the one or more bumpers and/or the door interface structure by the weight of the door.

In certain embodiments, the housing can include a first housing portion configured to mount to a wall, and a second housing portion configured to mount to the first housing portion. The door can be rotatably attached to the second housing portion. In certain embodiments, the housing can include a drip shield extending from the first housing portion.

In accordance with at least one aspect of this disclosure, a first housing portion for a wall exhaust vent can include a mounting plate comprising a vent opening, and a plurality of inner mounting holes defined through the mounting plate and located around the vent opening. The first housing portion can also include a plurality of outer mounting holes defined through the mounting plate and located further away from the vent opening than the inner mounting holes.

The first mounting portion can include a collar extending from the vent opening and configured to attach to exhaust ducting. The collar can include any suitable size and/or shape as appreciated by those having ordinary skill in the art in view of this disclosure.

The inner mounting holes can include four inner mounting holes and the outer mounting holes can include four outer mounting holes, for example. The inner mounting holes can form corners of a first square, and the outer mounting holes can form corners of a second square that is larger than the first square. Any other suitable number and/or positioning and/or pattern of inner/outer mounting holes is contemplated herein.

The first housing portion can include a mount tab extending from the mounting plate. The mounting tab can include one or more mount holes defined therethrough. The mount tab can be configured to be attached to a second housing portion of the wall exhaust vent to retain the second housing portion to the mounting plate.

The first housing portion can include a drip shield extending from the mounting plate (e.g., formed from a top of the mounting plate). The drip shield can be configured to cover the second housing portion of the wall exhaust vent and to at least partially retain the second housing portion to the first housing portion.

In accordance with at least one aspect of this disclosure, a wall exhaust vent kit can include a first housing portion configured to mount to a wall. The first housing portion can be any suitable first housing portion as disclosed herein (e.g., as described above). The mounting plate can be configured to abut a wall around a wall exhaust opening and can include a first vent opening, for example. The mounting plate can include a plurality of mounting holes defined through the mounting plate and located around the vent opening.

The kit can include a second housing portion configured to attach to the first housing portion. The second housing can include a second vent opening defined through the second housing portion and configured to at least partially align with the first vent opening. The kit can include a door rotatably attached to or configured to be rotatably attached to the second housing portion to at least partially cover the second vent opening.

The second housing portion can include a mount recess configured to receive the mount tab of the first housing portion, e.g., to form a substantially flush surface when the mount tab is connected to the second housing portion. Any other suitable components are contemplated herein (e.g., one or more fasteners to secure the first housing portion to the second housing portion, and/or to secure the mounting plate to the wall).

These and other features of the embodiments of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1:
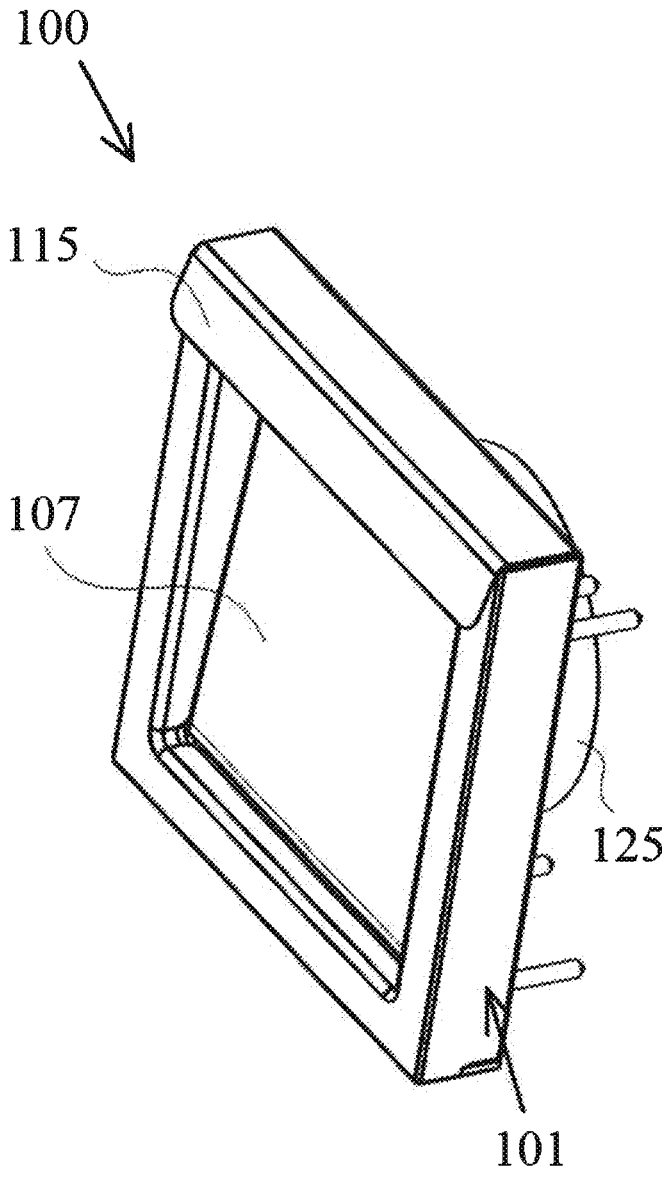
FIG. 1 is a perspective view of an embodiment of a wall exhaust vent in accordance with this disclosure.

Reference will now be made to the drawings wherein like reference numerals identify similar structural features or aspects of the subject disclosure. For purposes of explanation and illustration, and not limitation, an illustrative view of an embodiment of a wall exhaust vent in accordance with the disclosure is shown in FIG. 1 and is designated generally by reference character 100. Other embodiments and/or aspects of this disclosure are shown in FIGS. 2-17G.

Figure 2:
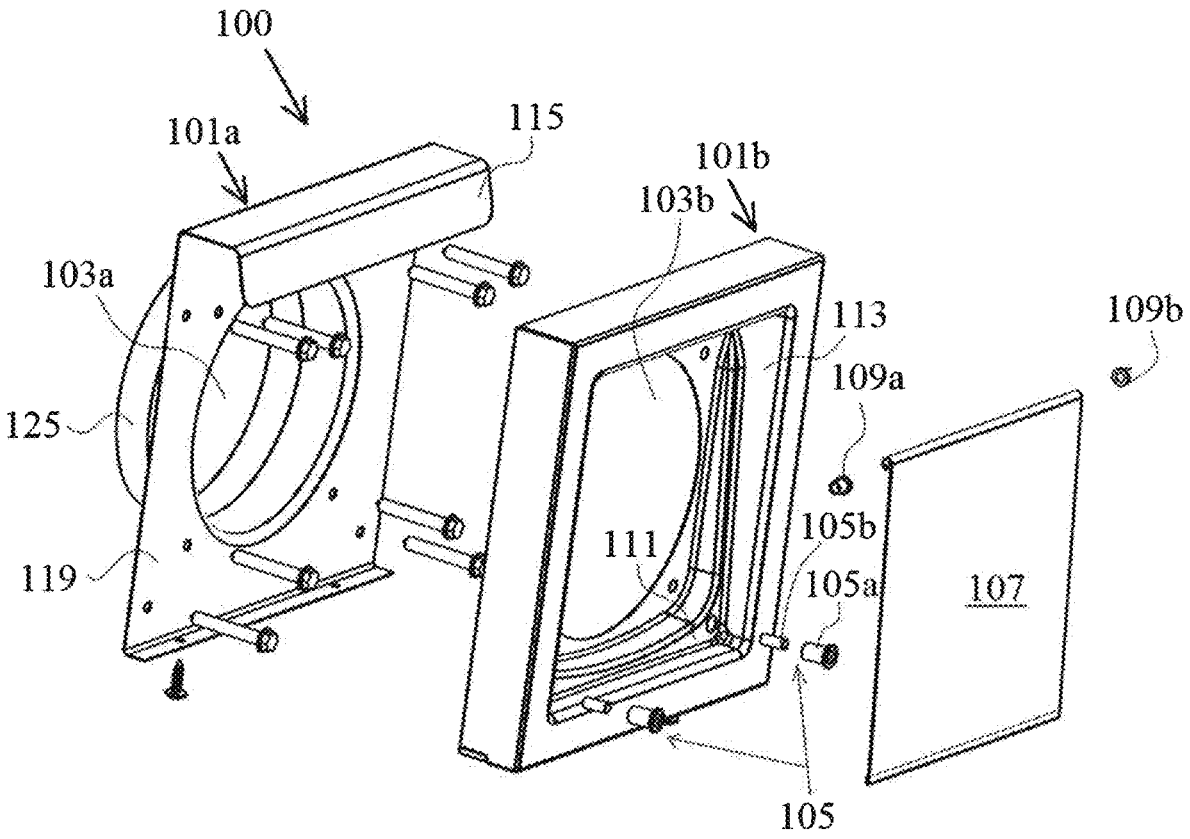
FIG. 2 is an exploded view of the embodiment of FIG. 1.
Figure 3:
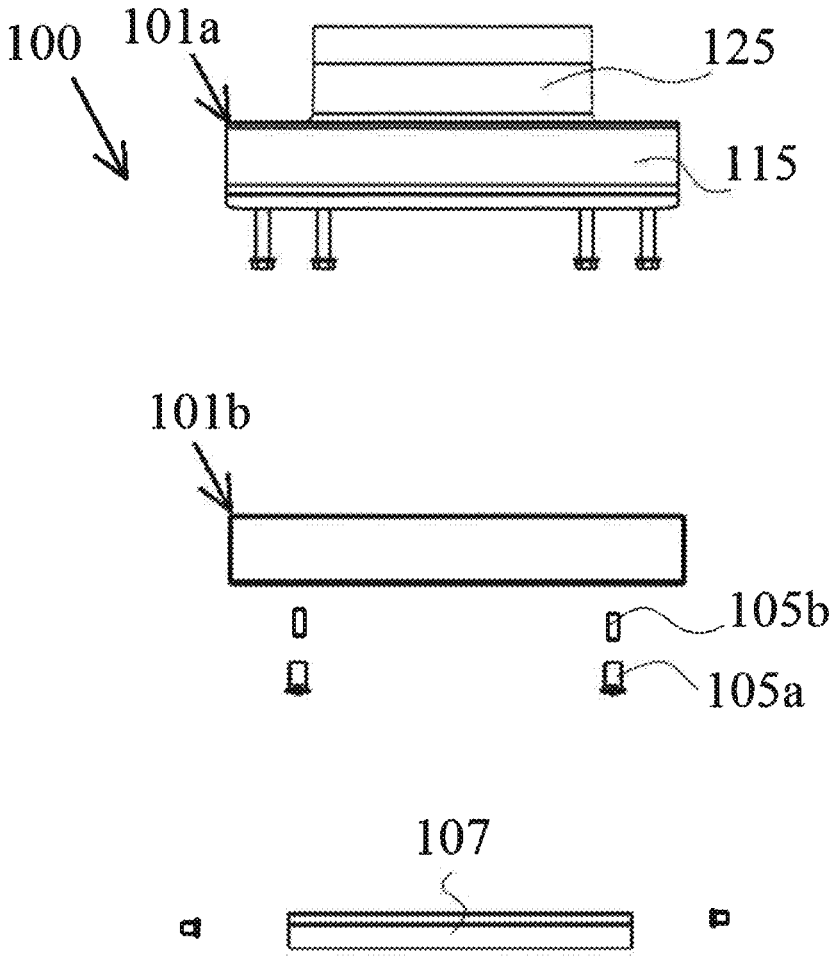
FIG. 3 is a top down plan view of the embodiment shown in FIG. 2.

In accordance with at least one aspect of this disclosure, referring generally to FIGS. 1-6 a wall exhaust vent 100 (e.g., for a dryer or other HVAC system) can include a housing 101. The housing can be a singular piece or include any suitable number of portions (e.g., a first housing portion 101*a* and a second housing portion 101*b* described in more detail below). The housing can define a vent opening 103 (e.g., defined by first vent opening 103*a* and second vent opening 103*b* as shown in FIG. 2).

Figure 4:
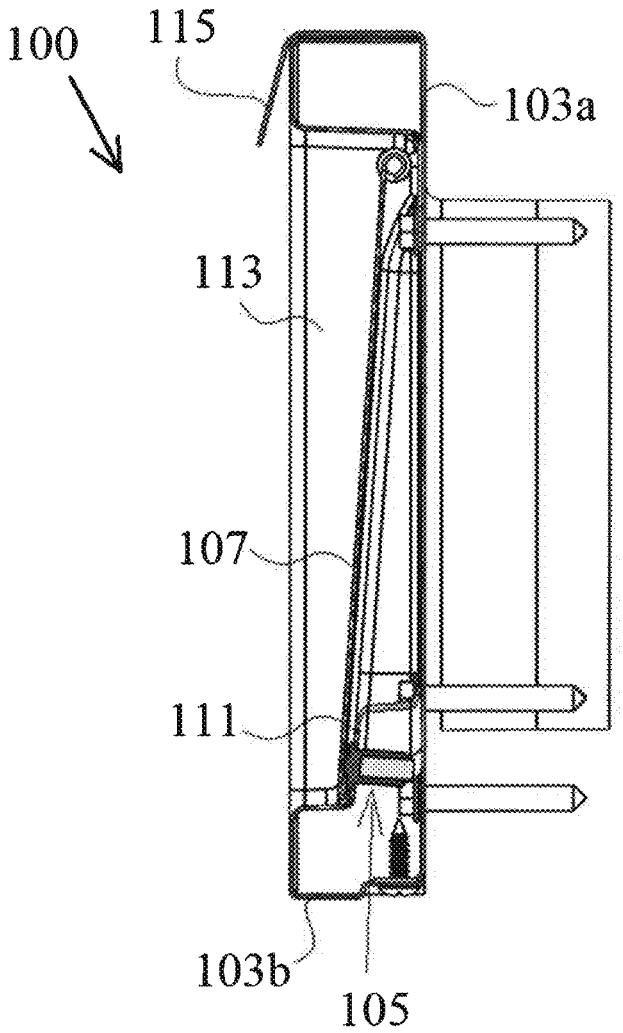
FIG. 4 is a cross-sectional view of the embodiment of FIG. 1, sectioned through an embodiment of a bumper thereof.
Figure 5:
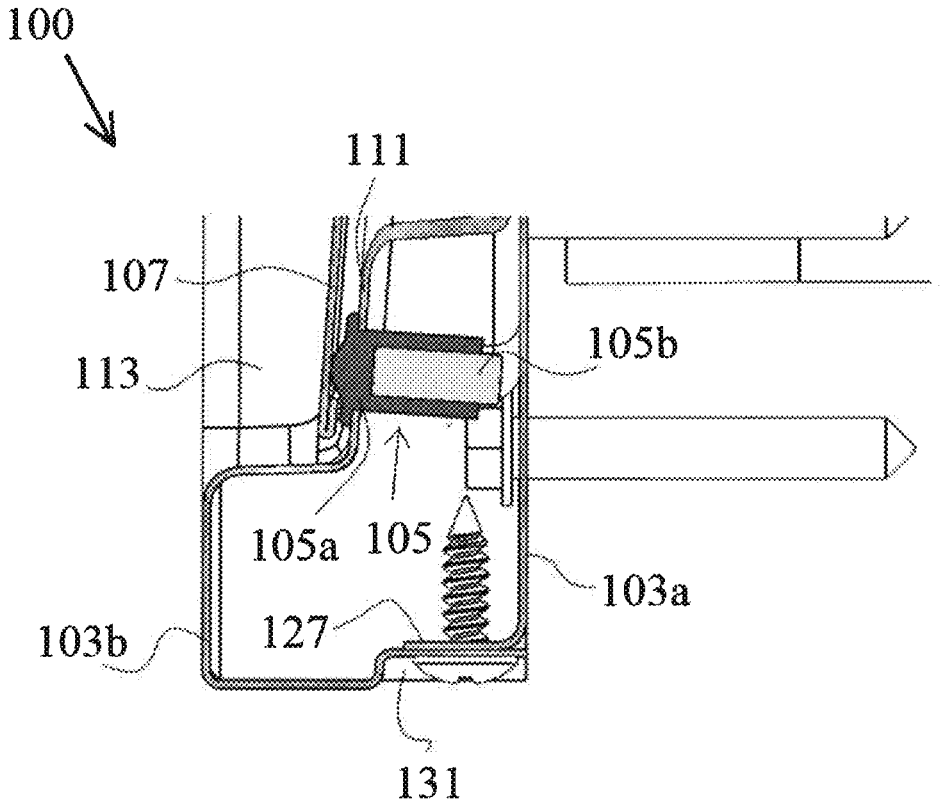
FIG. 5 is a partial, zoomed view of the cross-section of FIG. 4.
Figure 6:
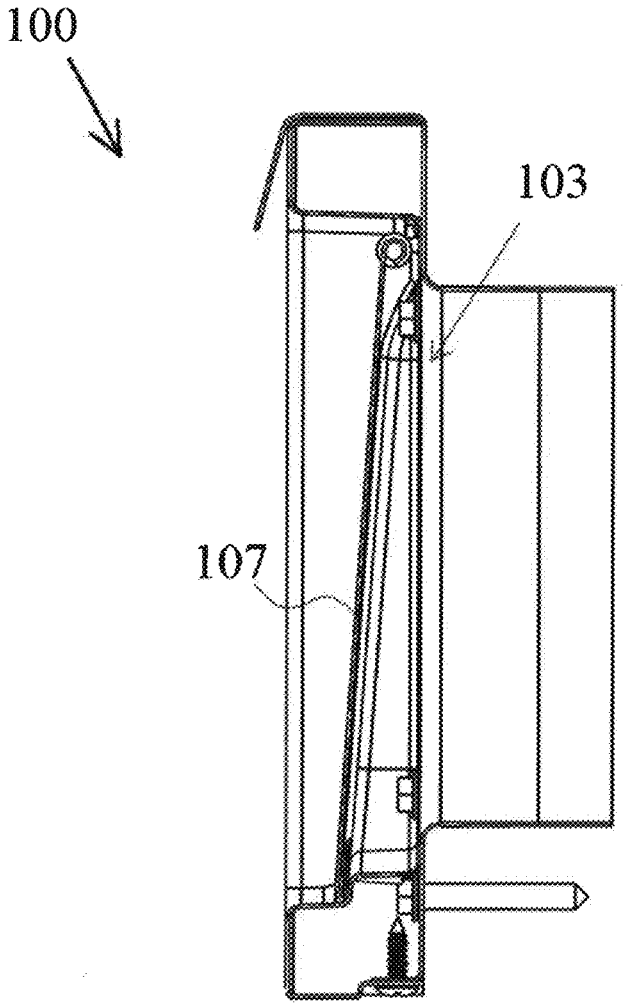
FIG. 6 is a cross-sectional view of the embodiment of FIG. 1, sectioned through a middle thereof.
Figure 7:
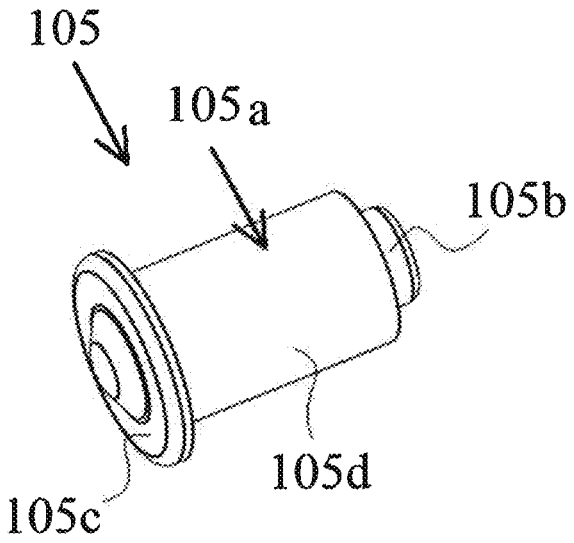
FIG. 7 is a perspective view of an embodiment of a bumper of the embodiment of FIG. 1.
Figure 8:
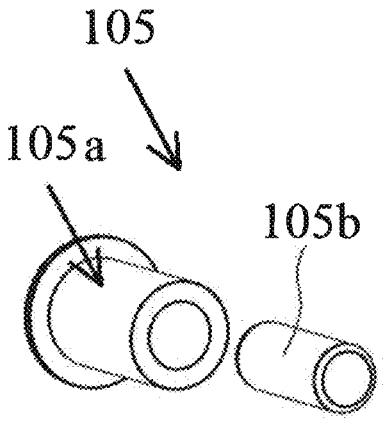
FIG. 8 is a rear exploded view of the embodiment of FIG. 7.
Figure 9:
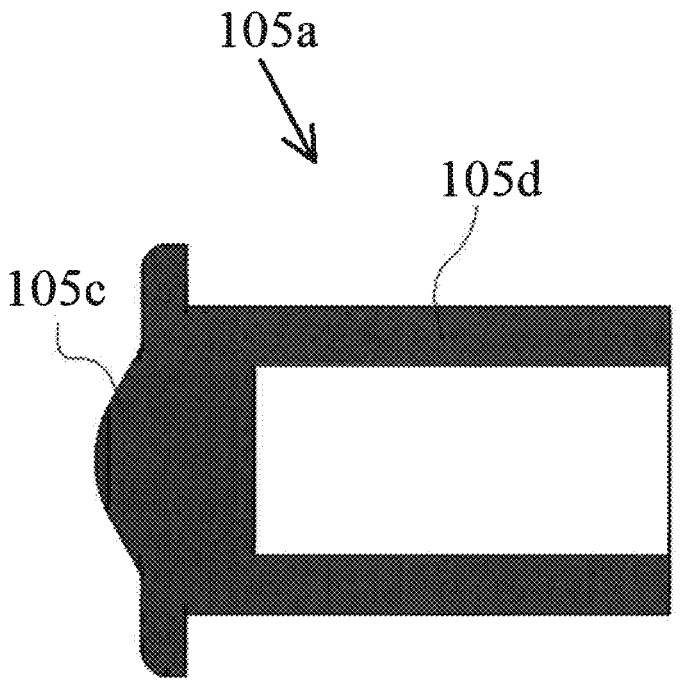
FIG. 9 is a cross-sectional view of an embodiment of a bumper body of the embodiment of FIG. 7.
Figure 10:
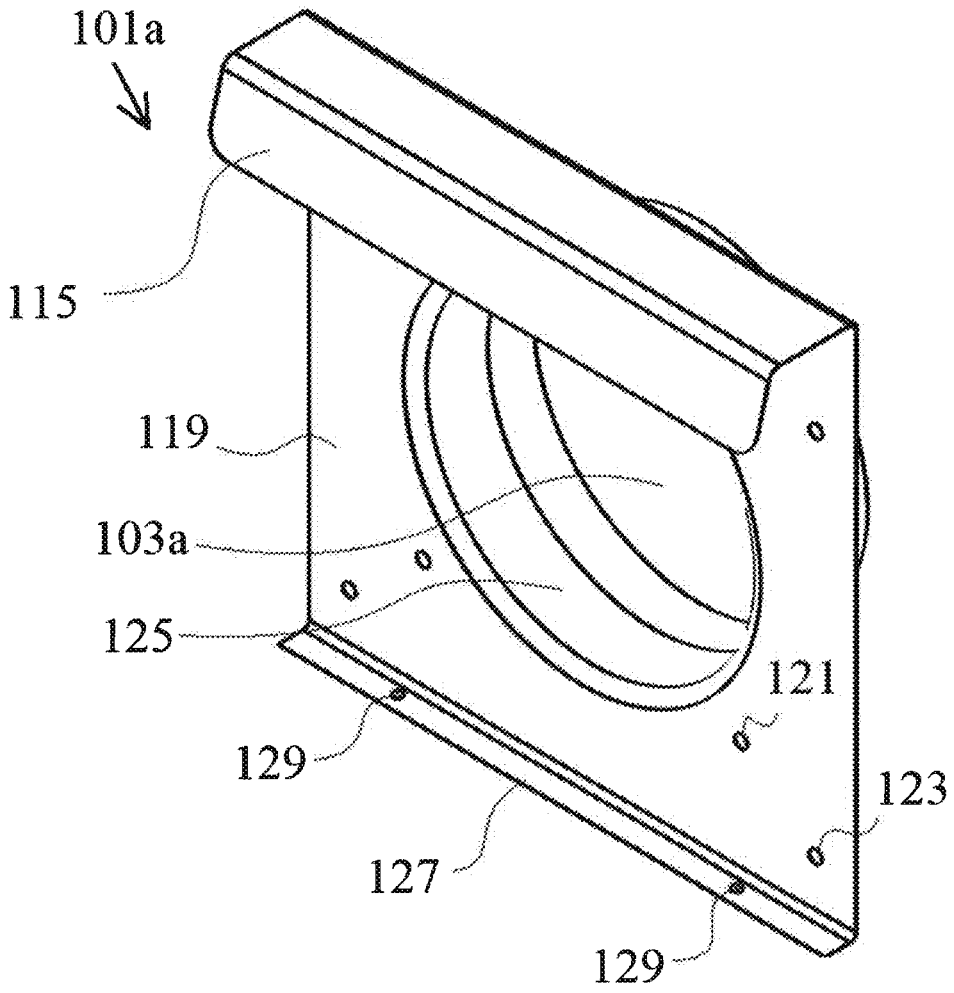
FIG. 10 is a perspective view of an embodiment of a first housing portion of the embodiment of FIG. 1.
Figure 11:
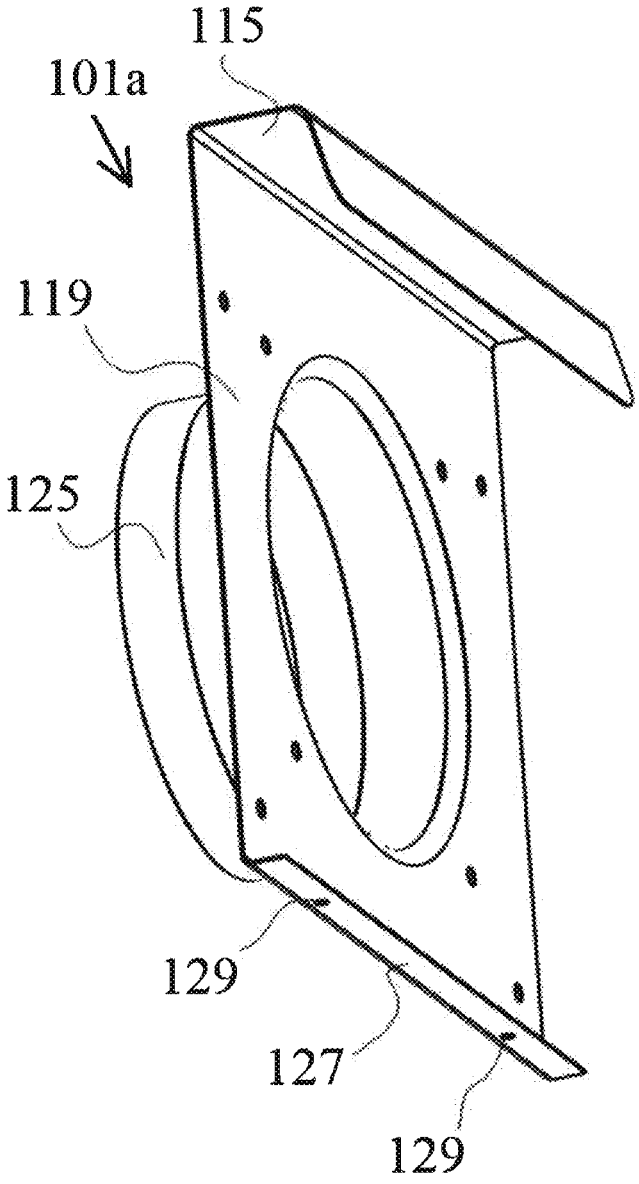
FIG. 11 is a perspective view of the embodiment of FIG. 10.
Figure 12:
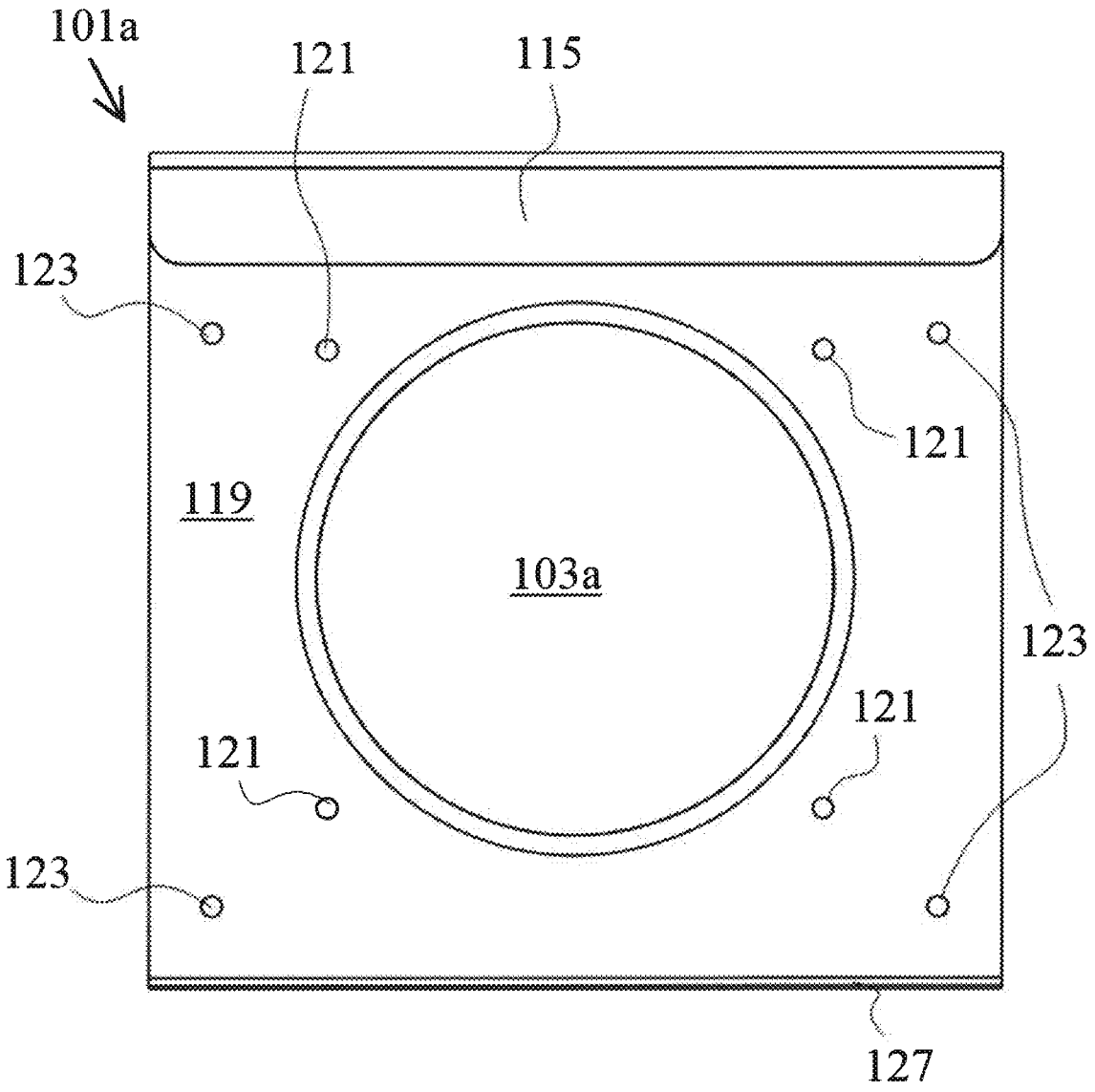
FIG. 12 is a front elevation view of the embodiment of FIG. 10.
Figure 13:
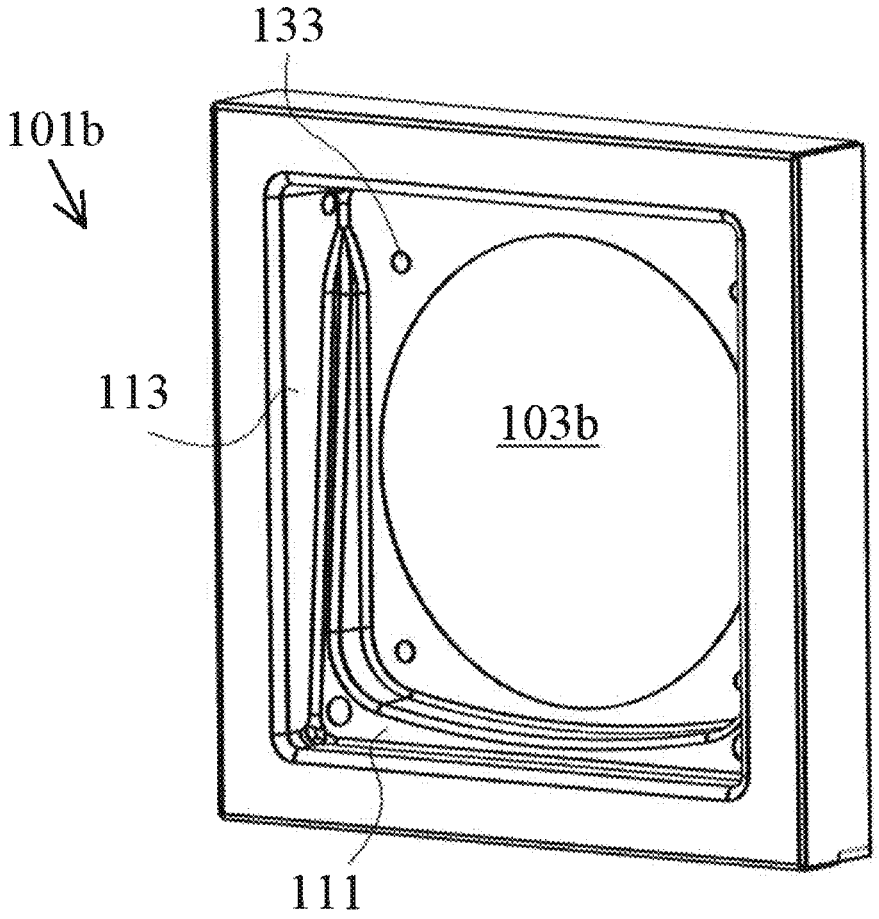
FIG. 13 is a perspective view of an embodiment of a second housing portion of the embodiment of FIG. 1.
Figure 14:
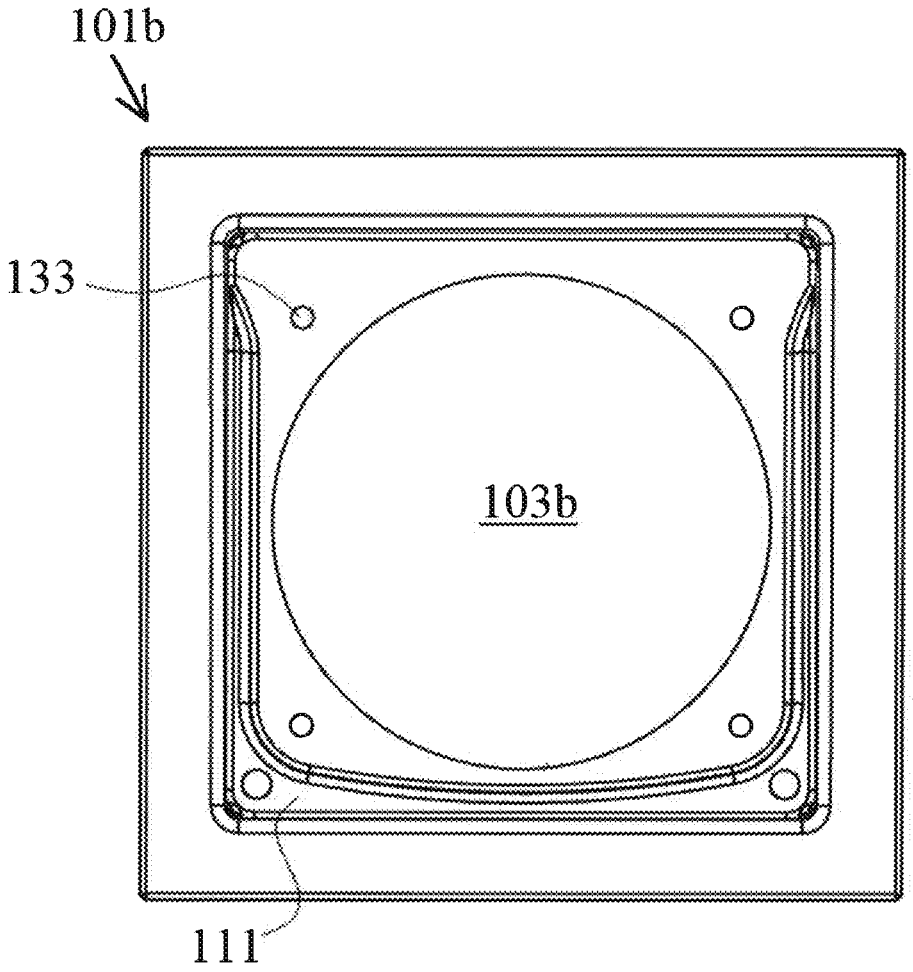
FIG. 14 is a front elevation view of the embodiment of FIG. 13.

Referring additionally to FIGS. 7-9, the wall vent 100 can include one or more bumpers 105 on or at least partially within the housing 101 and configured contact a door 107 of the wall exhaust vent 100 in a closed position (e.g., as shown in FIGS. 4-6). The one or more bumpers 105 can include a bumper body 105*a*, and a magnet 105*b* disposed at least partially within the bumper body 105*a* that is configured to magnetically interact with the door 107 of the wall exhaust vent 100 to bias the door 107 to the closed position.

As shown, the vent 100 can include the door 107 in a kit therewith and/or installed thereon. The door 107 can be rotatably attached to the housing 101 (e.g., via one or more hinge bars connected to one or more hinge mounts 109*a*, 109*b* disposed in the second housing portion 101*b*) and configured to at least partially cover the vent opening (e.g., second opening 103*b*) in the closed position (e.g., as shown in FIGS. 1 and 4-6).

Figure 17A:
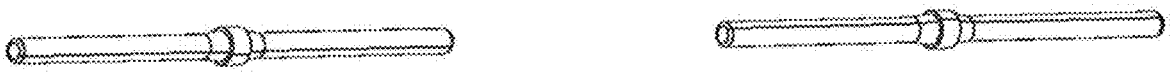
FIG. 17A is a view of an embodiment of a plurality of hinge pins in accordance with this disclosure.
Figure 17B:
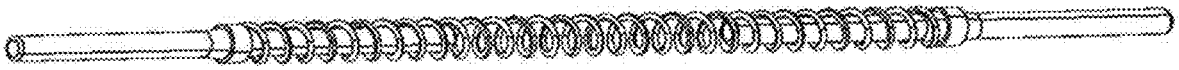
FIG. 17B shows an embodiment of a spring disposed between the hinge pins of FIG. 17A.
Figure 17C:
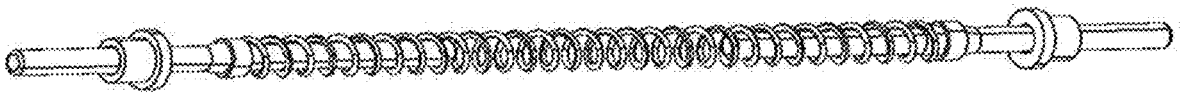
FIG. 17C shows a grommet disposed on each hinge pin of FIG. 17B.
Figure 17D:
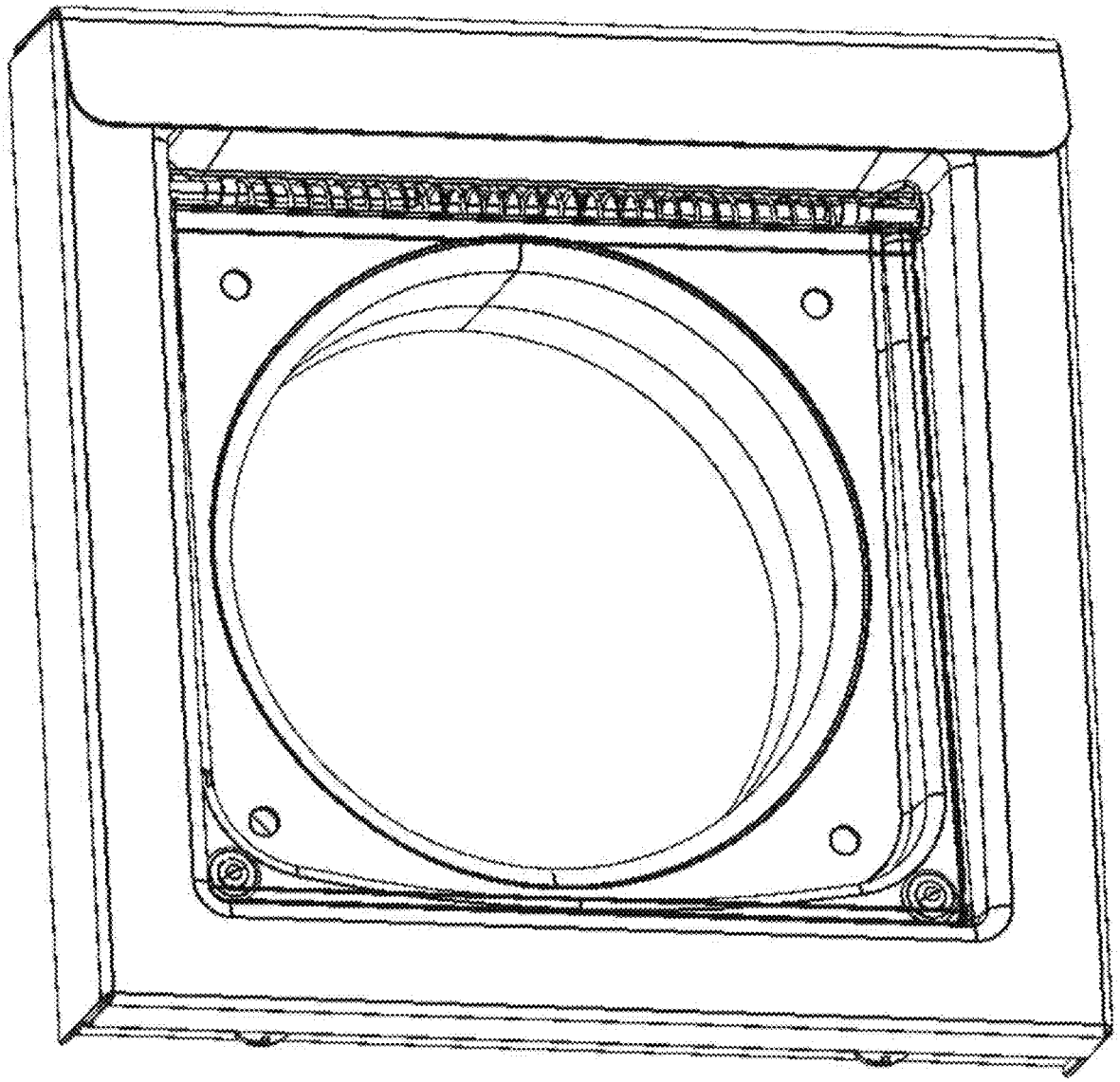
FIGS. 17D, 17E, and 17F show the embodiment of FIG. 17C installed on housing for illustrative purposes.
Figure 17E:
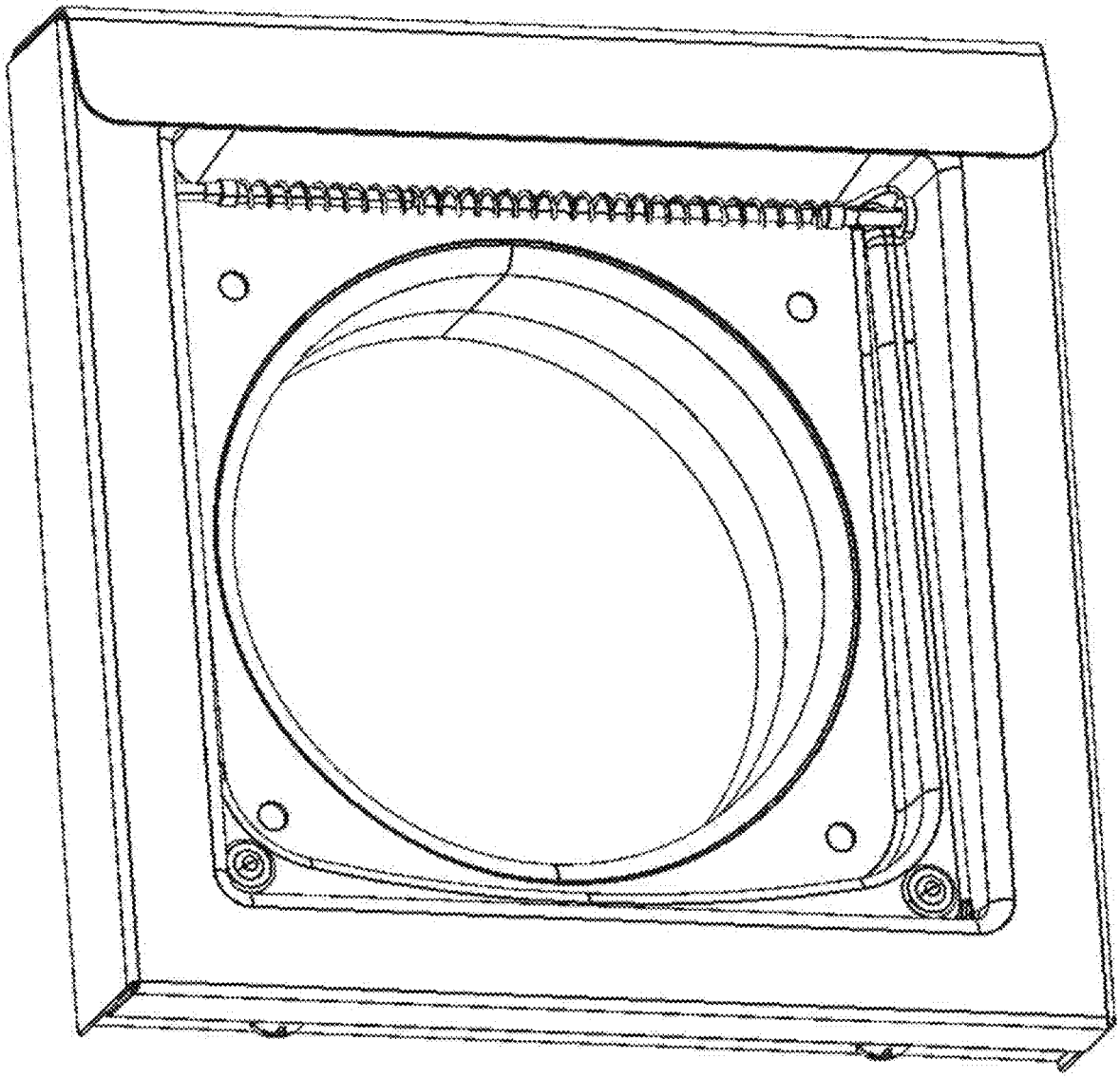
Figure 17F:
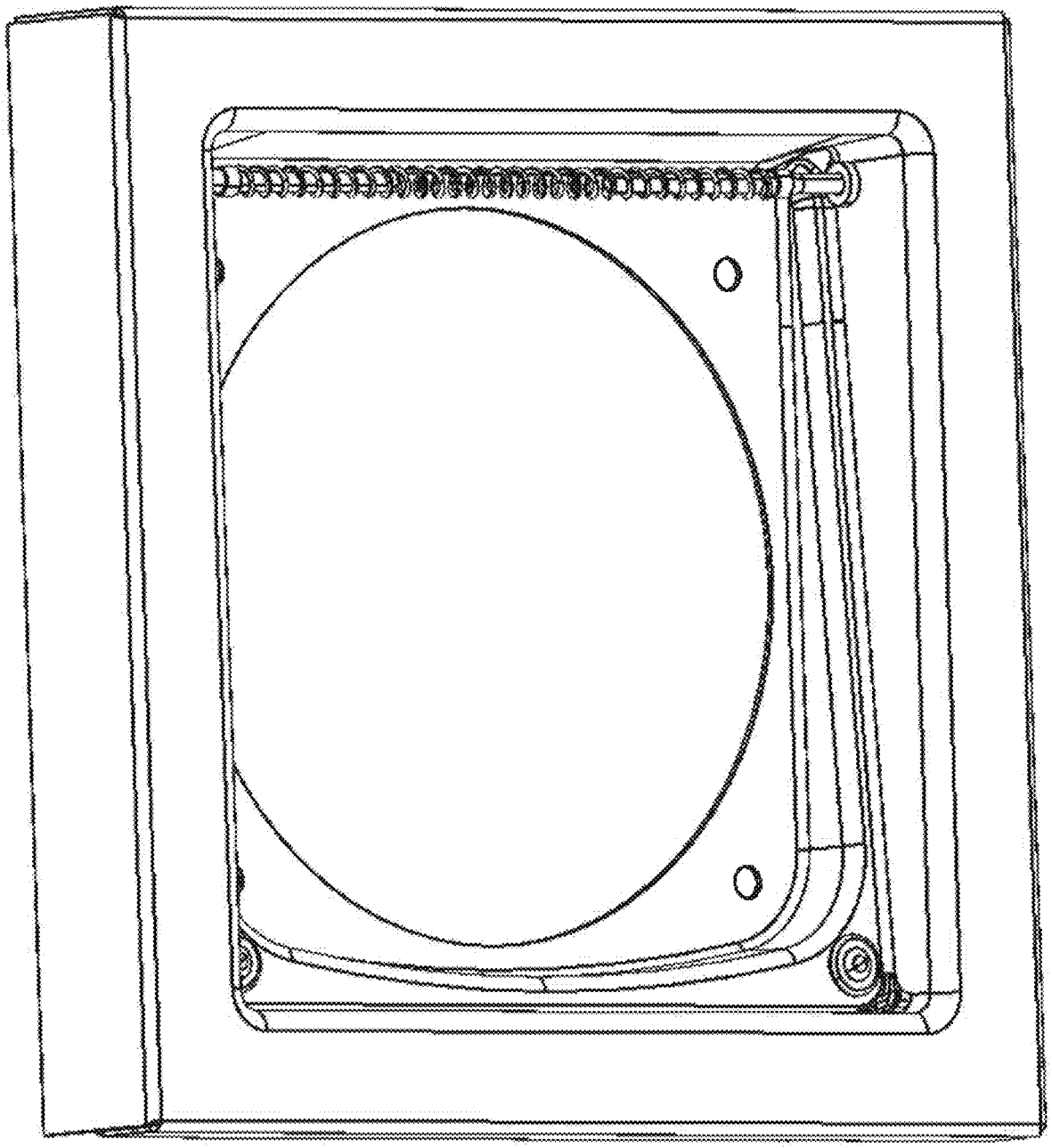
Figure 17G:
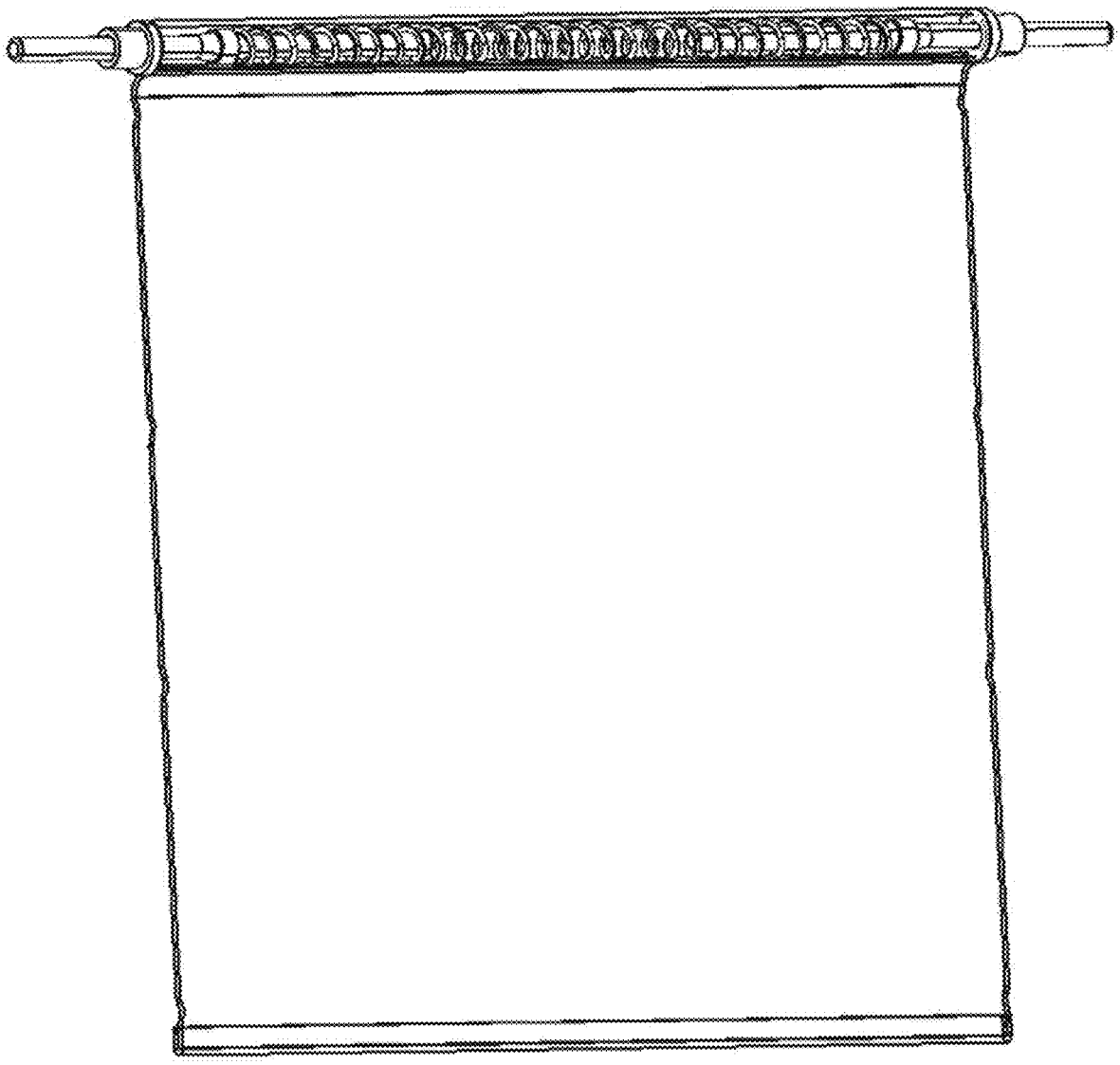
FIG. 17G show the embodiment of FIG. 17C embedded within an embodiment of a door in accordance with this disclosure.

Referring additionally to FIGS. 17A-17G, an embodiment of a hinge connection assembly is shown for attaching a door 107 to the housing 101. FIG. 17A shows an embodiment of a plurality of hinge pins. FIG. 17B shows an embodiment of a spring disposed between the hinge pins. FIG. 17C shows a grommet disposed on each hinge pin. FIGS. 17D, 17E, and 17F show the assembly installed on housing for illustrative purposes. FIG. 17G shows the embodiment of an assembly embedded within an embodiment of a door in accordance with this disclosure. As is appreciated by those having ordinary skill in the art with this disclosure, the hinge pins can be compressed together to allow insertion into respective holes in the housing 101 and are biased outwardly by the spring to retain the hinge pins within the hole. The grommets can be attached to the door 107 (e.g., a channel defined by the door) aid in guiding the hinge pins, for example. Any other suitable assembly is contemplated herein.

In certain embodiments the bumper body 105*a* can be made of an elastic material (e.g., to dampen sound of the door 107 colliding with the bumper 105 when closing). For example, the bumper body 105*a* can be made of silicone or rubber. Any other suitable material (e.g., any soft material) is contemplated herein.

In certain embodiments, the magnet 105*b* can be a permanent magnet. The door 107 can include (e.g., be formed at least partially by and/or have attached to) a ferromagnetic material (e.g., iron, nickel, or cobalt) or any other suitable material configured to be attracted to magnet 105*b*. In certain embodiments, the door 107 and/or any other suitable component can be made of non-metal (e.g., plastic), and can include a ferromagnetic material or magnet attached thereto to attract to the magnet 105*b*.

The magnet 105*b* can be a rare earth magnet, for example (e.g., neodymium). Any suitable type of magnet is contemplated herein. The magnet 105*b* size and/or strength can be selected as a function of the magnetic properties of the door 107 and/or one or more properties of an exhaust flow of the system connected to the vent 100 to provide a desired biasing force to the door 107 while also allowing the door 107 to open with the exhaust flow.

In certain embodiments, the bumper body 105*a* can include a flanged head portion 105*c* (e.g., with or without a bump as shown) and a hollow neck portion 105*d* configured to at least partially retain the magnet 105*b*. The flanged head portion can be shaped to have a peak as shown, and/or can include any other suitable shape. The flanged head portion 105*c* can allow insertion of the neck portion 105*d* into a bumper hole in the second housing portion 101*b* as shown and provide a backstop. The magnet 105*b* can include an outside diameter that is larger than the inside diameter of the hollow neck portion 105*d* such that the magnet 105*b* stretches the bumper slightly outward. For example, inserting the magnet into the bumper can force the outside diameter of the bumper to be slightly enlarged, achieving a strong friction fit when inserted into the holes in the housing.

Figure 16A:
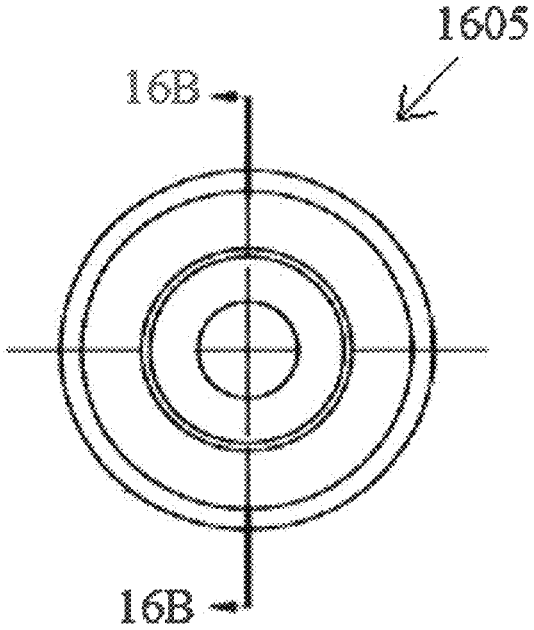
FIG. 16A is a plan view of another embodiment of a bumper in accordance with this disclosure.
Figure 16B:
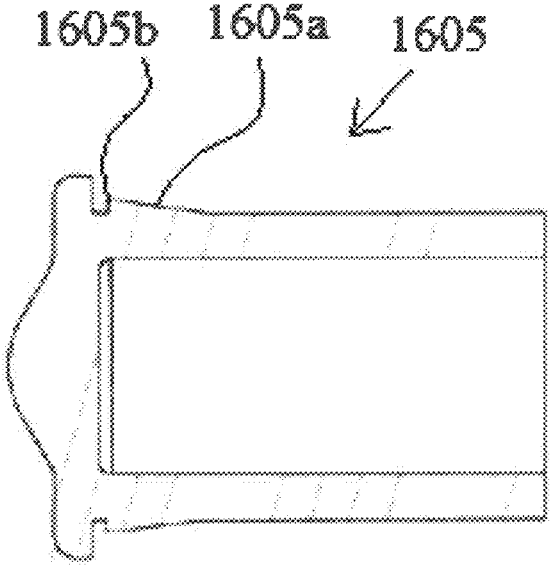
FIG. 16B is a cross-sectional view of the embodiment of FIG. 16A.

Referring to FIGS. 16A and 16B, in certain embodiments, a bumper 1605 can be similar to bumper 105 and have a ramped section 1605*a* (e.g., for aiding insertion) and/or a groove 1605*b* (e.g., for snapping in and retaining to the housing). Any other suitable dimensions, size, and/or shape for the bumper and/or the magnet is contemplated herein.

As shown, the one or more bumpers 105 can include two bumpers 105. Each bumper 105 can be positioned to be proximate (e.g., within one bumper width of the edge) to a lower corner of the door 107 in the closed position as shown.

In certain embodiments, the one or more bumpers 105 can be disposed partially within a door interface structure 111. The door interface structure 111 can be at least partially within a recess 113 of the housing 101 (e.g., a recess 113 defined in second housing 101*b*). In certain embodiments, the door interface structure 111 can be slanted, e.g., as shown) relative to a plane of the housing 101 (e.g., relative to a wall plane) such that the door 107 can be additionally biased to contact the one or more bumpers 105 and/or the door interface structure 111 by the weight of the door 107. As shown, the neck portion 105*d* of the one or more bumpers 105 can be inserted into a hole of in the door interface structure 111 and the flanged head portion 105*c* can contact the outer surface of the door interface structure 111. The door interface structure 111 can include an angled lower lip to weep out moisture and condensed liquid.

In certain embodiments, referring additionally to FIGS. 10-15, the housing 100 can include a first housing portion 101*a* configured to mount to a wall, e.g., over an exhaust opening in the wall (e.g., a dryer exhaust opening to connect with dryer ducting). The housing 100 can include a second housing portion 101*b* configured to mount to the first housing portion 101*a*. The door 107 can be rotatably attached to the second housing portion 101*b*. In certain embodiments, the housing 101 can include a drip shield 115 extending from the first housing portion 101*a*.

In certain embodiments, the first housing portion 101*a* can include a mounting plate 119 comprising a first vent opening 103*a*. The first housing portion 101*a* can also include a plurality of inner mounting holes 121 defined through the mounting plate 119 and located around the first vent opening 103*a*. The first housing portion 101*a* can also include a plurality of outer mounting holes 123 defined through the mounting plate 119 and located further away from the vent opening 103*a* than the inner mounting holes 121.

The first mounting portion 101*a* can include a collar 125 extending from the first vent opening 103*a* and configured to attach to exhaust ducting (e.g., of a dryer). The collar 125 can include any suitable size and/or shape as appreciated by those having ordinary skill in the art in view of this disclosure. In certain embodiments, there may be no collar.

The inner mounting holes 121 can include four inner mounting holes 121 and the outer mounting holes 123 can include four outer mounting holes 123, for example. As shown, in certain embodiments, the inner mounting holes 121 can form corners of a first square (e.g., or any other suitable four corner shape), and the outer mounting holes 123 can form corners of a second square (e.g., or any other suitable four corner shape) that is larger than the first square (e.g., or any other suitable shape). Any other suitable number and/or positioning and/or pattern of inner/outer mounting holes 121, 123 is contemplated herein. The preformed mounting holes 121, 123 can allow mounting to walls having various (normal or larger) wall openings sizes without a user having to form their own holes and damaging a coating or material of the mounting plate 119.

The first housing portion 101*a* can include a mount tab 127 extending from the mounting plate 119. The mounting tab 127 can include one or more mount holes 129 defined therethrough. The mount tab 127 can be configured to be attached to a second housing portion 101*b* of the wall exhaust vent 100 to retain the second housing portion 101*b* to the mounting plate 119.

As disclosed above, the first housing portion 101*a* can include a drip shield 115 extending from the mounting plate 119 (e.g., formed from a top of the mounting plate). As shown in FIGS. 1, 4, and 6, for example, the drip shield 115 can be configured to cover the second housing portion 101*b* of the wall exhaust vent 100. For example, the drip shield 115 can at least partially retain the second housing portion 101*b* to the first housing portion 101*a*, e.g., without requiring one or more fasteners between a top portion of the second housing 101*b* and the first housing 101*a*.

In accordance with at least one aspect of this disclosure, a wall exhaust vent kit can include a first housing portion 101*a* configured to mount to a wall. The first housing portion 101*a* can be any suitable first housing portion 101*a* as disclosed herein (e.g., as described above). The mounting plate 119 can be configured to abut a wall around a wall exhaust opening (e.g., an opening in a wall where exhaust ducting is located) and can include a first vent opening 103*a*, for example. The mounting plate 119 can include a plurality of mounting holes, e.g., 123, 125 defined through the mounting plate 119 and located around the vent opening 103*a*.

The kit can include a second housing portion 101*b* configured to attach to the first housing portion 101*b*. The second housing portion 101*b* can include any suitable portion of housing 100, e.g., as shown and described above, and/or any other suitable features as appreciated by those having ordinary skill in the art in view of this disclosure. As disclosed above, the second housing portion 101*b* can include a second vent opening 103*b* defined through the second housing portion 101*b* and configured to at least partially align with the first vent opening 103*a*, for example. The kit can include a door 107 rotatably attached to or configured to be rotatably attached to the second housing portion 101*b* to at least partially cover the second vent opening 103*b* (e.g., and thus the first vent opening 103*a*).

Figure 15:
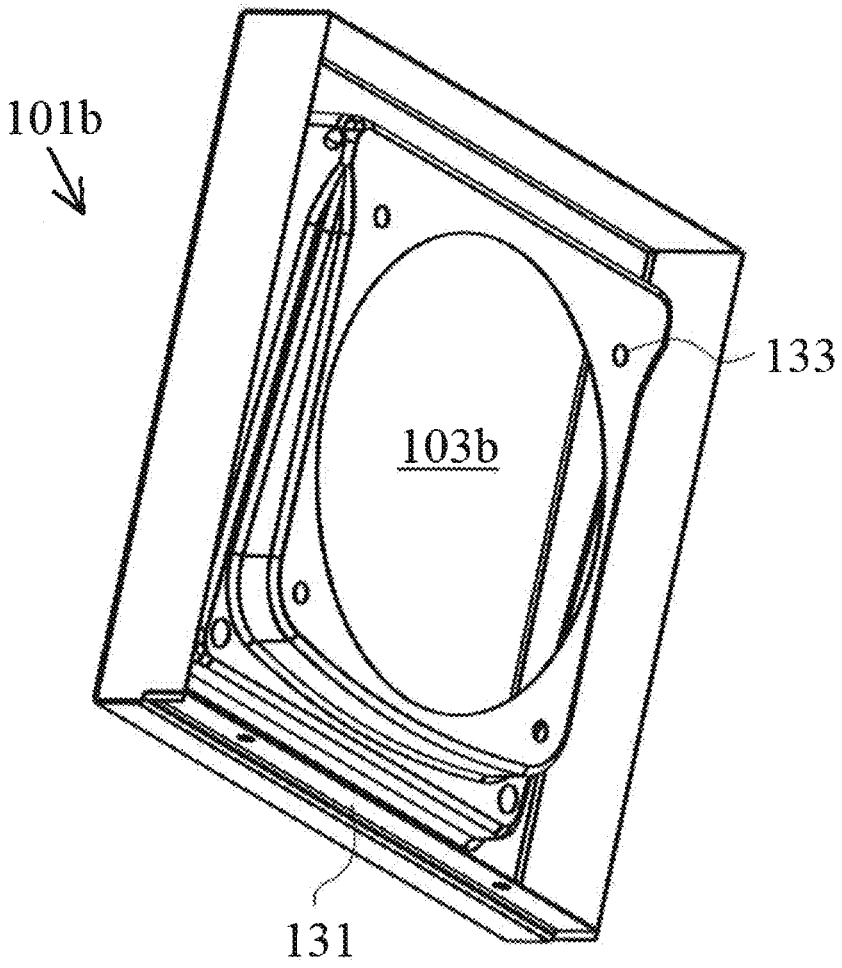
FIG. 15 is a rear perspective view of the embodiment of FIG. 13.

Referring to FIGS. 5 and 15, the second housing portion 101*b* can include a mount recess 129 configured to receive the mount tab 127 of the first housing portion 101*a*, e.g., to form a substantially flush surface when the mount tab 127 is connected to the second housing portion 101*b* (e.g., such that one or more fasteners do no protrude past a bottom surface of the second housing portion 101*b* as shown).

The second housing portion 101*b* can include one or more inner mount holes 133 that align with the inner mounting holes 121 of the mounting plate 119. The inner mount holes 133 can allow the second housing portion to be directly connected to a wall using a wall fastener (e.g., a concrete screw), e.g., where the wall opening is not so large as to reach the inner mount holes 133. In certain embodiments, the inner mount holes 133 can allow connection between the first housing portion 101*a* and the second housing portion 101*b*, e.g., with a short screw where the wall opening covers the location of the inner mounting holes 121.

The kit can include any other suitable components. For example, the kit can include one or more fasteners to secure the first housing portion to the second housing portion, and/or one or more fasteners to secure the mounting plate to the wall.

Certain embodiments include a single-louvered damper exterior termination exhaust vent for uses commonly associated with clothes exhausts or the like. Embodiments and/or one or more portions thereof can be manufactured with 22-gauge metal through a deep drawn process or any other suitable process. Certain embodiments can include an angled damper door and integrated magnets to ensure the vent remains closed when exposed to pressure variations such as wind gusts or when the exhaust system is not in use.

In certain embodiments, the damper door can operate on a single hinge allowing easy duct cleaning accessibility. Embodiments can include an integrated drip shield above the damper door which can cover the hinge pin connection for added weather protection. Embodiments of a housing can include two parts that mechanically attach at the base with two screws and friction fits at the sides and top of the housings, for example. In certain embodiments, upon final installation on a structure facade, four additional screws can be used to solidify the connection between the front, e.g., first housing portion and back, e.g., second housing portion. Further, the front housing can be removed from the back housing portion to expose a secondary installation option with pre-drilled screw holes on the back plate located further away from the primary pre-drilled screw holes available on the front housing. In certain embodiments, the entire assembly can be finished with a powder-coated paint for additional corrosion resistance and can include one or more bumpers to aid in minimizing sound from the damper door resting within the recessed frame. Embodiments can be utilized for vertical wall installations on all facade types, for example.

As disclosed above, a drip edge can aid in minimizing the threat of water intrusion due to driven rain in windy environments, the damper door can be recessed into the frame's body to minimize any flapping or metal clanking sounds from updrafts or wind gusts, the damper can be angled and allows gravity to close the single louvered vent within the lower lip of the frame, and integrated magnets and sound dampening rubber bumpers can aid in securing a closed vent quietly when the exhaust system is not in use. Any other suitable advantages to one or more embodiments of this disclosure are contemplated herein.

Those having ordinary skill in the art understand that any numerical values disclosed herein can be exact values or can be values within a range. Further, any terms of approximation (e.g., "about", "approximately", "around") used in this disclosure can mean the stated value within a range. For example, in certain embodiments, the range can be within (plus or minus) 20%, or within 10%, or within 5%, or within 2%, or within any other suitable percentage or number as appreciated by those having ordinary skill in the art (e.g., for known tolerance limits or error ranges).

Any suitable combination(s) of any disclosed embodiments and/or any suitable portion(s) thereof are contemplated herein as appreciated by those having ordinary skill in the art.

The embodiments of the present disclosure, as described above and shown in the drawings, provide for improvement in the art to which they pertain. While the subject disclosure includes reference to certain embodiments, those skilled in the art will readily appreciate that changes and/or modifications may be made thereto without departing from the spirit and scope of the subject disclosure.

What is claimed is:

1. A first housing portion for a wall exhaust vent, comprising:

a mounting plate comprising a vent opening;

a plurality of inner mounting holes defined through the mounting plate and located around the vent opening; and a plurality of outer mounting holes defined through the mounting plate and located further away from the vent opening than the inner mounting holes, wherein the inner mounting holes include four inner mounting holes, wherein the outer mounting holes include four outer mounting holes, wherein the inner mounting holes form corners of a first square, and the outer mounting holes form corners of a second square that is larger than the first square wherein the inner mounting holes are configured to align with inner mounting holes on a second housing portion to mount the mounting plate to a wall through the inner mounting holes of both the mounting plate and the second housing portion, wherein the outer mounting holes are not configured to align with any mounting holes in the second housing portion with the first and second housing portions connected to one another.

2. The first housing portion for a wall exhaust vent of claim 1, further comprising a collar extending from the vent opening and configured to connect to exhaust ducting.

3. The first housing portion for a wall exhaust vent of claim 1, further comprising a mount tab extending from the mounting plate, the mounting tab comprising one or more mount holes defined therethrough, wherein the mount tab is configured to be attached to a second housing portion of the wall exhaust vent to retain the second housing portion to the mounting plate.

4. The first housing portion for a wall exhaust vent of claim 1, further comprising a drip shield extending from the mounting plate, wherein the drip shield is configured to cover the second housing portion of the wall exhaust vent and to at least partially retain the second housing portion to the first housing portion.

5. A housing portion for a wall exhaust vent, comprising:

a housing portion defining a vent opening;

a plurality of mounting holes defined through the housing portion and located around the vent opening; and a drip shield extending obliquely from a top of the housing portion, above the vent opening, wherein the drip shield is integral with the housing portion, wherein a bottom edge of the drip shield is above the vent opening, wherein the drip shield is above a damper door of the wall exhaust vent to cover a hinge pin of the damper door of the wall exhaust vent.

6. The housing portion for a wall exhaust vent of claim 5, further comprising a collar extending from the vent opening and configured to connect to exhaust ducting.

7. A housing portion for a wall exhaust vent, comprising:

a housing portion defining a vent opening;

a plurality of mounting holes defined through the housing portion and located around the vent opening; and a drip shield extending obliquely from a top of the housing portion, above the vent opening, wherein the drip shield is integral with the housing portion, wherein a bottom edge of the drip shield is above the vent opening; and a collar extending from the vent opening and configured to connect to exhaust ducting.

* * * * *